US007256169B2

(12) United States Patent
Schimmel et al.

(10) Patent No.: US 7,256,169 B2
(45) Date of Patent: Aug. 14, 2007

(54) PULVERULENT LAUNDRY AND CLEANING DETERGENT INGREDIENT CONSISTING OF POLYCARBOSYLATE AND SILICATE

(75) Inventors: Günther Schimmel, Erftstadt (DE); Harald Bauer, Kerpen (DE); Josef Holz, Erftstadt (DE); Volker Thewes, Monheim (DE); Richard Mertens, Krefeld (DE); Peter Hardt, Monheim (DE); Matthias Berghahn, Krefeld (DE); Thomas Müller, Meerbusch (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 1549 days.

(21) Appl. No.: 08/994,479

(22) Filed: Jan. 30, 2001

(65) Prior Publication Data

US 2004/0176268 A1 Sep. 9, 2004

(51) Int. Cl.
*C11D 3/08* (2006.01)
*C11D 3/37* (2006.01)

(52) U.S. Cl. ..... 510/511; 510/276; 510/318; 510/398; 510/434; 510/444; 510/445; 510/477; 510/531; 510/533

(58) Field of Classification Search ..... 510/276, 510/318, 398, 434, 444, 445, 511, 477, 531, 510/533
See application file for complete search history.

(56) References Cited

U.S. PATENT DOCUMENTS

| | | | | | |
|---|---|---|---|---|---|
| 1,514 | A | * | 3/1840 | Willman et al. | 100/211 |
| 3,923,742 | A | | 12/1975 | Haschke et al. | |
| 4,839,461 | A | | 6/1989 | Boehmke | |
| 5,175,361 | A | | 12/1992 | Denzinger et al. | |
| 5,221,733 | A | | 6/1993 | Koskan et al. | |
| 5,227,446 | A | | 7/1993 | Denzinger et al. | |
| 5,315,010 | A | | 5/1994 | Koskan et al. | |
| 5,391,764 | A | | 2/1995 | Koskan et al. | |
| 5,457,176 | A | | 10/1995 | Adler et al. | |
| 5,534,179 | A | * | 7/1996 | Miracle et al. | 510/305 |
| 5,538,728 | A | * | 7/1996 | Yanaki et al. | 424/401 |
| 5,540,855 | A | * | 7/1996 | Baillely et al. | 510/276 |
| 5,552,514 | A | | 9/1996 | Adler et al. | |
| 5,554,721 | A | | 9/1996 | Adler et al. | |
| 5,556,938 | A | | 9/1996 | Freeman et al. | |
| 5,574,120 | A | | 11/1996 | Heidel et al. | |
| 5,576,277 | A | * | 11/1996 | MacBeath et al. | 510/113 |
| 5,580,941 | A | | 12/1996 | Krause et al. | |
| 5,610,255 | A | | 3/1997 | Groth et al. | |
| 5,663,133 | A | * | 9/1997 | Goldstein | 510/224 |
| 5,698,510 | A | * | 12/1997 | Wilkinson et al. | 510/444 |
| 5,736,502 | A | * | 4/1998 | Wilkinson | 510/444 |
| 5,773,400 | A | * | 6/1998 | Baillely et al. | 510/315 |
| 5,780,410 | A | * | 7/1998 | Baillely et al. | 510/220 |
| 5,883,064 | A | * | 3/1999 | Baeck et al. | 510/320 |
| 5,919,747 | A | * | 7/1999 | Kazuta et al. | 510/444 |
| 5,965,507 | A | * | 10/1999 | Thoen et al. | 510/320 |
| 5,972,040 | A | * | 10/1999 | Moss et al. | 8/137 |

FOREIGN PATENT DOCUMENTS

| | | |
|---|---|---|
| AU | 58592/94 | 8/1994 |
| CA | 2038332 | 9/1991 |
| CA | 2155126 | 9/1994 |
| CA | 2179777 | 6/1995 |
| CA | 2196336 | 2/1996 |
| DE | 4415623 | 11/1995 |
| DE | 19516957 | 11/1996 |
| EP | 457025 | 11/1991 |

OTHER PUBLICATIONS

Derwent Abstracts.

* cited by examiner

*Primary Examiner*—Charles Boyer
(74) *Attorney, Agent, or Firm*—Richard P. Silverman

(57) ABSTRACT

The invention relates to a pulverulent laundry and cleaning detergents ingredient, to a process for its preparation and to its use.

21 Claims, 1 Drawing Sheet

Figure 1:
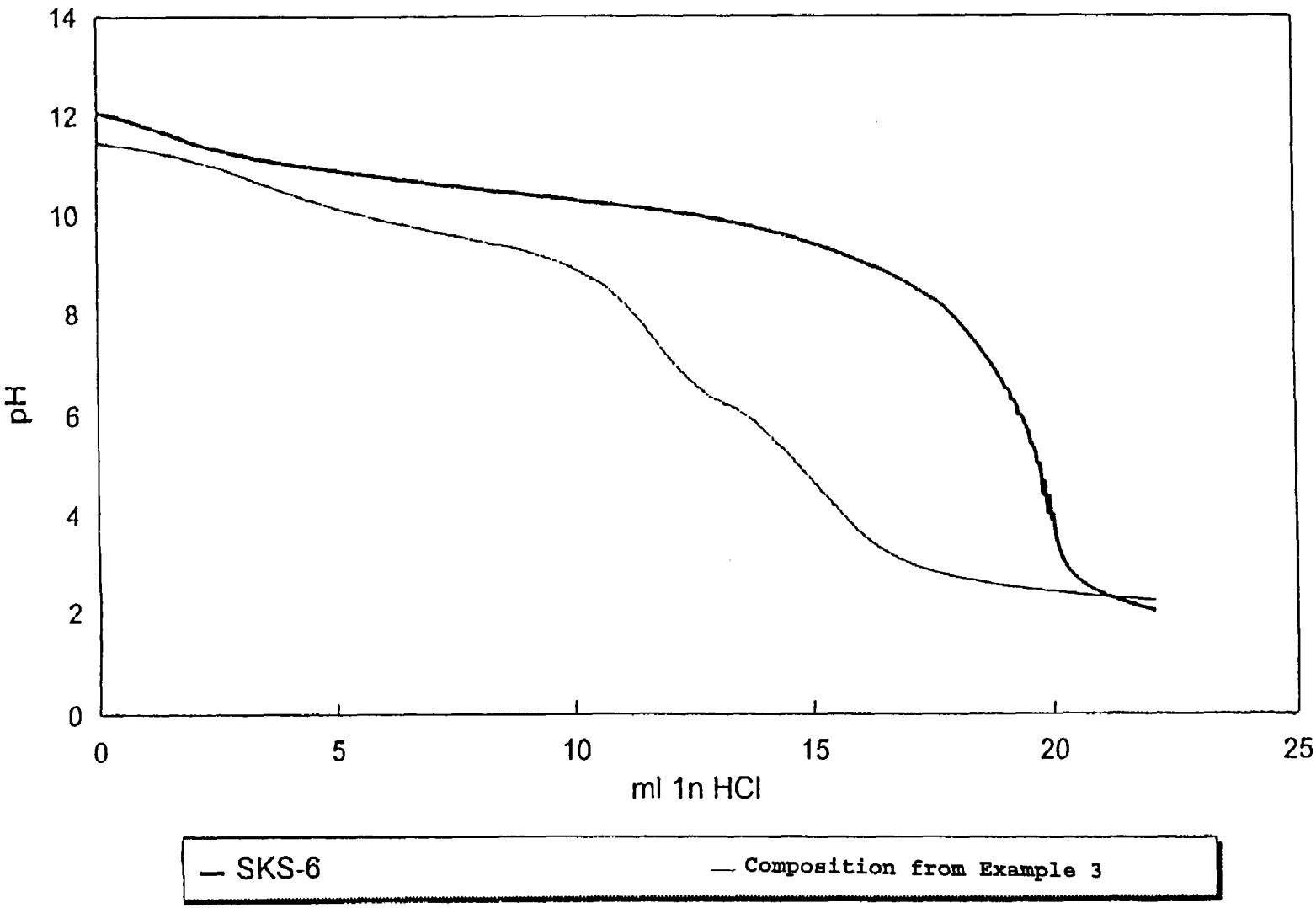

PULVERULENT LAUNDRY AND CLEANING DETERGENT INGREDIENT CONSISTING OF POLYCARBOSYLATE AND SILICATE

The invention relates to a pulverulent laundry and cleaning detergents ingredient, to a process for its preparation and to its use.

Customary commercial detergents and cleaners include a large number of ingredients which perform a series of different functions. The quality of such detergents and cleaners depends both on the nature and quantity of ingredients used and also on the manner and order in which these ingredients are added.

For example, the main components of modern textile detergents are, inter alia, surfactants, bleaches, washing alkalis and builders. Accordingly, the main components of cleaning and dishwashing detergents are predominantly builders, bleaches, alkalis, dispersants and enzymes.

An ideal builder for textile detergents performs a series of functions and, for example, contributes considerably to water softening. Moreover, it should have a very high carrying capacity for liquid components and permit adequate buffering of the wash liquor.

The builders hitherto used most frequently are sodium tripolyphosphate (NaTPP), the zeolites A and P and crystalline silicates such as, for example, $Na_2Si_2O_5$ which is also called SKS-6.

Water softening (removal or binding of the calcium ions and/or magnesium ions which cause water hardness) is achieved in different ways with the aforementioned builders. For example, the sodium tripolyphosphate dissolves and, with the calcium ions and magnesium ions, forms soluble complexes which do not interfere with the washing process.

On the other hand, the zeolites and also the phyllosilicates form insoluble complexes with the calcium ions and magnesium ions. The zeolites produce considerably larger quantities of insoluble complexes. These particles, which are in the form of solids in the wash liquor, have to be kept in suspension by additional detergent ingredients and must not be deposited on the textile fiber. This also applies to other (solid) dirt particles and any precipitated constituents of water hardness.

Cleaners for automatic dishwashing must also comprise components which are able to keep the dissolved dirt in suspension and prevent redeposition onto the ware.

Suitable additional detergent ingredients are the cobuilders which are also called polyelectrolyte compounds. These include citric acid, nitrilotriacetic acid, homo- and copolymers of acrylic acid, polyaspartic acid and starch oxidation products. The above ingredients can also be used in cleaners and dishwashing detergents.

Of particular interest are the polycarboxylates which are used as polymers having a molecular weight of approximately 2000 to 100,000. They comprise various carboxylic acids and the corresponding monomers. In pulverulent textile detergents and also in dishwashing detergents, they are usually used in the form of their neutral sodium salts, as a solid or alternatively as an aqueous solution.

In common textile detergents, the quantities of builders are usually from 10 to 40% by weight and those of cobuilders usually from 1 to 10% by weight, based on the total amount of pulverulent textile detergent. For cleaners and dishwashing detergents, the quantities added are of a similar order of magnitude.

Pulverulent textile detergents which include crystalline silicates as builder usually require smaller amounts of cobuilder than those which include only zeolite A as builder.

Zeolite A cannot, however, be used in dishwashing detergents because of its insolubility, only soluble components being suitable here.

The quality and the mode of action of such a builder/cobuilder system for textile detergents can, for example, be measured using secondary detergency. Secondary detergency indicates in particular to what extent such a builder/cobuilder system is able to prevent deposition onto the textile fibers. To take the measurement the washed fabric is incinerated and the amount of ash is determined gravimetrically.

For dishwashing detergents, the mode of action of the above builder/cobuilder systems can be ascertained quantitatively by visual inspection using a grading system for the resoiling of the ware.

In customary processes, the sodium polycarboxylates are introduced either as an aqueous solution or in powder form during production of the washing powder. The aqueous solution is sprayed onto the other solid detergent components in order to obtain a completely flowable product. One component having particularly good absorption is the phyllosilicate SKS-6 from Hoechst AG, Frankfurt am Main, which is able to ensure good flowability of the washing powder.

Although pure powder mixtures of SKS-6 and the sodium salt of a polycarboxylate have good washing performance properties, in some cases as good as the other builders sodium tripolyphosphate and zeolite already mentioned at the start, the quality of such systems, mainly in relation to secondary detergency, is still not satisfactory. Likewise, when such mixtures are used for dishwashing detergents there is sometimes the disadvantage of limescale deposits as a result of low solubility of the SKS-6.

The object of the invention is therefore to provide a composition which overcomes the aforementioned disadvantages and which provides excellent washing and cleaning results, in particular as regards secondary detergency.

This object is achieved by a pulverulent laundry and cleaning detergents ingredient which comprises a reaction product of an alkaline silicate and an acidic polycarboxylate.

The weight ratio of alkaline silicate to acidic polycarboxylate is preferably (40 to 1):1.

The weight ratio of alkaline silicate to acidic polycarboxylate is particularly preferably (20 to 2):1.

The acidic polycarboxylate used is preferably an unneutralized or only partially neutralized homo- and/or copolymer of acrylic acid, methacrylic acid, maleic acid, polyaspartic acid, saccharic acid and/or other monomers.

The pulverulent laundry and cleaning detergents ingredient preferably comprises from 50 to 98% by weight of an alkaline silicate and from 2 to 50% by weight of a copolymer of from 10 to 70% by weight of maleic acid, from 20 to 85% by weight of acrylic acid and/or methacrylic acid, from 1 to 50% by weight of vinyl acetate and from 0 to 10% by weight of other monomers having a degree of neutralization of from 0 to 70%.

The alkaline silicate is preferably of the formula $xM_2O\ ySiO_2\ zH_2O$ having a molar ratio of $SiO_2$ to $M_2O$ of (1 to 3.5):1 where z=0 to 4 and M=Na and/or K, and may contain up to 1% by weight of other elements and/or compounds.

The alkaline silicate is preferably an amorphous sodium silicate.

The alkaline silicate is particularly preferably a crystalline sodium silicate.

The alkaline silicate is particularly preferably a crystalline sodium phyllosilicate.

The other elements and/or compounds are preferably aluminum, titanium, iron, calcium, magnesium and/or their compounds.

The above object is also achieved by a process for preparing a pulverulent laundry and cleaning detergents ingredient which comprises depositing an acidic polycarboxylate solution onto an alkaline silicate.

From 2 to 60 parts by weight of acidic polycarboxylate solution are preferably deposited onto 100 parts by weight of alkaline silicate.

From 10 to 40 parts by weight of acidic polycarboxylate solution are particularly preferably deposited onto 100 parts by weight of alkaline silicate.

The polycarboxylate solution used is preferably an unneutralized or only partially neutralized homo- and/or copolymer of acrylic acid, methacrylic acid, maleic acid, polyaspartic acid, saccharic acid and/or other monomers.

The acidic polycarboxylate solution is preferably deposited onto the alkaline silicate in a solids mixer which contains a liquid-spraying device.

The reaction product of alkaline sodium silicate and acidic polycarboxylate solution is preferably dried at temperatures of from 40 to 150° C. for a period of from 5 to 120 minutes.

The invention also relates to the use of the pulverulent laundry and cleaning detergents ingredient according to the invention for preparing detergents.

The pulverulent laundry and cleaning detergents ingredient according to the invention is preferably used for preparing detergents by the dry mixing process.

The invention also relates to the use of the pulverulent laundry and cleaning detergents ingredient according to the invention for preparing cleaner compositions.

The pulverulent laundry and cleaning detergents ingredient according to the invention is preferably used for preparing cleaning detergent compositions for cleaning hard surfaces.

The invention also relates to the use of the pulverulent laundry and cleaning detergents ingredient according to the invention for preparing dishwashing compositions.

The pulverulent laundry and cleaning detergents ingredient according to the invention is preferably used for preparing dishwashing compositions for automatic dishwashing.

Suitable polycarboxylates for preparing the pulverulent laundry and cleaning detergents ingredient according to the invention are unneutralized acid group-containing and/or partially neutralized acid group-containing polymers.

Such polymers include the homopolymers of acrylic acid and or of methacrylic acid and their copolymers having further ethylenically unsaturated monomers, such as, for example, acrolein, dimethylacrylic acid, ethylacrylic acid, vinylacetic acid, allylacetic acid, maleic acid, fumaric acid, itaconic acid, meth(allylsulfonic acid), vinylsulfonic acid, styrenesulfonic acid, acrylamidomethylpropanesulfonic acid, and monomers containing phosphoric acid groups, such as, for example, vinylphosphonic acid, allylphosphonic acid and acrylamidomethylpropanephosphonic acid and their salts, and hydroxyethyl(meth)acrylate sulfates, allylalcohol sulfates and allylalcohol phosphates.

The aforementioned polymers are described, for example, in DE-A-23 57 036, DE-A-44 39 978, EP-A-0 075 820 or EP-A-0 451 508.

Polymers particularly suitable for the application according to the invention are biodegradable terpolymers which can be obtained by polymerization of a) from 10 to 70% by weight of monoethylenically unsaturated dicarboxylic acids having from 4 to 8 carbon atoms or their salts
b) from 20 to 85% by weight of monoethylenically unsaturated monocarboxylic acids having from 3 to 10 carbon atoms or their salts
c) from 1 to 50% by weight of monounsaturated monomers which, after saponification, release hydroxyl groups on the polymer chain
d) from 0 to 10% by weight of other free-radically copolymerizable monomers, the sum of monomers in a) to d) being 100% by weight, in aqueous solution, and saponification of the monomers in c). For the application according to the invention, saponification is preferably carried out in acid conditions. Products of the aforementioned type are described in DE-A-43 00 772 and DE-A-195 16 957.

Polymers also suitable for the application according to the invention are graft polymers of monosaccharides, oligosaccharides, polysaccharides and modified polysaccharides, as described in DE-A-40 03 172 and DE-A-44 15 623.

Graft polymers with proteins of animal and vegetable origin, in particular also with modified proteins, which are described in EP-A-0 457 025, are also well suited for the application according to the invention.

From the group of graft copolymers, copolymers of sugar or other polyhydroxy compounds and a monomer mixture of the following composition are preferably used:

a) from 45 to 96% by weight of monoethylenically unsaturated $C_3$ to $C_{10}$-monocarboxylic acid or mixtures of $C_3$ to $C_{10}$-monocarboxylic acids and/or their salts having monovalent cations
b) from 4 to 55% by weight of monoethylenically unsaturated monomers containing monosulfonic acid groups, monoethylenically unsaturated sulfuric acid esters, vinylphosphonic acid and/or the salts of these acids having monovalent cations
c) from 0 to 30% by weight of water-soluble, monoethylenically unsaturated compounds which are modified with from 2 to 50 mol of alkylene oxide per mole of monoethylenically unsaturated compound.

Such compounds are described in DE-A-42 21 381 and DE-A-43 43 993.

Other suitable polymers are polyaspartic acids and their derivatives in the unneutralized or only partially neutralized form. Polyaspartic acids usually exist in the form of their alkali metal salts or ammonium salts. As a result, the unneutralized or only partially neutralized products can be obtained by the addition of corresponding amounts of organic or inorganic acids and, if necessary, removal of the resulting salts.

Such products can also be obtained by the thermal reaction of maleic acid and ammonia or by the condensation of aspartic acid and the subsequent hydrolysis of the resulting polysuccinimide. The preparation of such products is described, for example, in DE-A-36 26 672, DE-A-43 07 114, DE-A-44 27 287, EP-A-0 612 784, EP-A-0 644 257 and PCT/WO 92/14753.

Particularly suitable graft polymers for preparing the pulverulent laundry and cleaning detergents ingredient according to the invention are graft polymers of acrylic acid, methacrylic acid, maleic acid and other ethylenically unsaturated monomers based on salts of polyaspartic acid, as are usually produced during the hydrolysis of polysuccinimide described previously. In this case, the acid which otherwise must be added to prepare the only partially neutralized form of polyaspartic acid is not required. The quantity of polyaspartate is usually chosen such that the degree of neutralization of all carboxyl groups incorporated in the polymer does not exceed 80%, preferably 60%. Products of the aforementioned type are described in more detail in PCT/WO 94/01486.

Preferred ranges for the previously described polymers are:

Mean molecular mass: 1000 to 100,000 g/mol, preferably 2000 to 70,000 g/mol and particularly preferably 2000 to 35,000 g/mol.

Degree of neutralization of the acid groups: 0 to 90%, preferably 30 to 70%.

Water content of the polymer solutions: 30 to 70% by weight, preferably 40 to 60% by weight.

Viscosity of the polymer solutions: less than 600 Pa·s at 20° C.

The pH of the polymer solution should be less than 5.5.

Preparation of the copolymers is described by the following examples Polymer 1 to Polymer 5.

Polymer 1

150 g of maleic anhydride, 200 g of sodium hydroxide solution (50% by weight), 360 g of water and 0.01 g of ammonium iron sulfate (Mohr's salt) are introduced into a reactor fitted with stirrer, heating and cooling devices, distillation column, internal thermometer and metering means, and are heated to 90° C. with stirring. At this temperature, the addition of 275 g of acrylic acid in 200 g of water and 100 g of sodium hydroxide solution (50% by weight) and of a second solution of 1.5 g of sodium persulfate and 15 g of hydrogen peroxide (35% by weight) in 75 g of water is started simultaneously. The addition takes a total of 4 hours. The mixture is stirred for a further hour, and then approximately 350 g of water are distilled off, giving a slightly cloudy, high-viscosity solution having a dry substance content of approximately 55% by weight, a pH of 5.0 and a Brookfield viscosity of 580 Pa·s at 20° C. The weight-average molar mass, determined by gel permeation chromatography, is 69,500 g/mol.

Polymer 2

230 g of maleic anhydride, 340 g of sodium hydroxide solution (50% by weight), 410 g of water and 0.3 g of ammonium iron sulfate (Mohr's salt) are introduced into the reactor described above and heated to 90° C. with stirring. At this temperature, the addition of a solution of 293 g of acrylic acid in 158 g of water and 130 g of sodium hydroxide solution (50% by weight) and of a second solution of 16 g of sodium persulfate and 135 g of hydrogen peroxide (35% by weight) in 83 g of water is started simultaneously. The addition takes a total of 4 hours. The mixture is stirred for a further hour, and then approximately 540 g of water are distilled off, giving a light brown, clear solution having a dry substance content of approximately 55% by weight, a pH of 5.3 and a Brookfield viscosity of 4700 mPa·s at 20° C. The weight-average molar mass, determined by gel permeation chromatography, is 5500 g/mol.

Polymer 3

178 g of maleic anhydride, 240 g of sodium hydroxide solution (50% by weight), 360 g of water, 12 g of sodium methallylsulfonate and 0.01 g of ammonium iron sulfate (Mohr's salt) are introduced into the reactor described above and heated to 90° C. with stirring. At this temperature, the addition of 230 g of acrylic acid and 60 g of vinyl acetate in 75 g of water and 90 g of sodium hydroxide solution (50% by weight) and of a second solution of 10 g of sodium persulfate and 80 g of hydrogen peroxide (35% by weight) in 75 g of water is started simultaneously. The addition takes a total of 4 hours. The mixture is stirred for a further hour under reflux, and then approximately 420 g of water are distilled off, giving a viscous solution having a dry substance content of approximately 55% by weight, a pH of 4.8 and a Brookfield viscosity of 55,000 mPa·s at 20° C. The weight-average molar mass, determined by gel permeation chromatography, is 21,000 g/mol.

Polymer 4

88 g of maleic anhydride, 130 g of sodium hydroxide solution (50% by weight), 0.01 g of ammonium iron sulfate (Mohr's salt) and 450 g of a 25% by weight solution of the sodium salt of polyaspartic acid having a mean molecular weight of 12,000 g/mol are introduced into the reactor described above and heated to 90° C. with stirring. At this temperature, the addition of a solution of 205 g of acrylic acid, 150 g of water and 90 g of sodium hydroxide solution (50% by weight) and of a second solution of 5 g of sodium persulfate and 10 g of hydrogen peroxide (35% by weight) in 75 g of water is started simultaneously. The addition takes a total of 4 hours. The mixture is stirred for a further hour, and then approximately 300 g of water are distilled off, giving a viscous, brown product having a dry substance content of approximately 55% by weight, a pH of 5.0 and a Brookfield viscosity of 84,000 mPa·s at 20° C. The weight-average molar mass, determined by gel permeation chromatography, is 60,000 g/mol.

Polymer 5

200 g of water, 80 g of acrylic acid, 60 g of sucrose and 20 g of sodium methallylsulfonate are introduced into the reactor described above and neutralized at 20° C. with 16 g of sodium hydroxide solution (50% by weight). Polymerization is initiated at 20 to 25° C. by the addition of 5 g of mercaptoethanol, 0.01 g of ammonium iron sulfate (Mohr's salt) and 1.6 g of hydrogen peroxide (30% by weight). The mixture heats up to approximately 80 to 90° C. Stirring is continued for a further 30 minutes at 75-85° C., and then 4 g of sodium peroxodisulfate and 4 g of sodium disulfite are added to the reaction mixture. Stirring is continued for a further 90 minutes, and water is then distilled off under reduced pressure until a solids content of approximately 55% by weight has been achieved. The clear polymer solution has a pH of 3.7 and a Brookfield viscosity of 190 mPa·s at 20° C. The weight-average molecular mass, determined by gel permeation chromatography, is 2400 g/mol.

The following Examples 1 to 8 describe the preparation of the pulverulent laundry and cleaning detergents ingredient according to the invention and its use.

EXAMPLES 1 TO 3

In each case, 2 kg of SKS-6 powder are sprayed with an aqueous solution of polymer 3 in a Lödige plowshare mixer. The quantities used are given in Table 1. Powders which can be granulated to a high degree are produced, which become slightly tacky as the amount of polymer increases. The powders are dried in a fluidized bed at 120° C. for 10 minutes.

This drying significantly improves the flowability of the powders, as can be seen from the flow factor in Table 1.

Compared to SKS-6, the powders have a clearly reduced alkalinity, as is evident from FIG. 1 which plots reserve alkalinity (titration curve of 2 g of product in each case with 1N of HCl). The reserve alkalinity indicates how much acid is needed to lower a substance to a certain pH above 5.

TABLE 1

| Preparation of the laundry and cleaning detergents ingredient according to the invention using 2 kg of SKS-6 powder in each case | | | | | | |
|---|---|---|---|---|---|---|
| | | | After drying | | | |
| Example | Amount of polycarboxylate solution | pH of damp component* | % $H_2O$ | % active substance of cobuilder | Flowability** damp | Flowability** dried |
| 1 | 222 | 11.66 | 3.5 | 5.6 | 15 | 23 |
| 2 | 500 | 11.59 | 5.5 | 11.5 | 11 | 28 |
| 3 | 1140 | 11.4 | 8 | 22 | 11 | 270 |

*measured as 0.1% solution
**Flowability: the flow factor (FFC) according to Jenike is determined by shear force measurement and is a measure of the flowability of a powder. The reference values are: <1: solidified, 1-2: nonflowing, 2-4: cohesive, 4-10: readily flowable, >10 freely flowable.

EXAMPLES 4 AND 5

Comparison

Two textile detergents in powder form are prepared in a Lödige plowshare mixer, the components being added in the order given in Table 2.

EXAMPLES 6 AND 7

According to the Invention

Pulverulent textile detergents are prepared as in Examples 4 and 5, but replacing pure SKS-6 with a mixture of SKS-6 and the pulverulent laundry and cleaning detergents ingredient SKS-6/polycarboxylate according to Example 3. In terms of overall composition, Examples 4 and 6 on the one hand and 5 and 7 on the other are identical and are therefore placed next to one another (Table 2).

TABLE 2

| Compositions according to Examples 4 to 7 | | | | |
|---|---|---|---|---|
| | % content | | | |
| Ingredient | Example 4 | Example 6 | Example 5 | Example 7 |
| SKS-6 | 40 | 27.3 | 20 | 7.3 |
| Zeolite A | — | — | 25 | 25 |
| Component from Example 3 | — | 18.15 | — | 18.15 |
| Sodium polycarboxylate* | 4 | — | 4 | — |
| LAS | 9 | 9 | 9 | 9 |
| Nonionic | 8 | 8 | 8 | 8 |
| Sodium percarbonate | 20 | 20 | 20 | 20 |
| TAED | 5 | 5 | 5 | 5 |
| Enzymes | 2 | 2 | 2 | 2 |
| Antifoam | 1 | 1 | 1 | 1 |
| Sodium sulfate | 11 | 9.55 | 6 | 4.55 |
| pH** | 10.9 | 10.9 | 10.4 | 10.3 |

*Commercial product ("W74454") from Stockhausen (dried, pulverulent)
**at 5 g/l of washing powder and 18° German water hardness (corresponds to 180 mg of CaO/l)

EXAMPLE 8

The detergents from Examples 4 to 7 are subjected to a washing test and tested for their secondary detergency. This is carried out by washing 5 standard fabrics together with 4.5 kg of ballast fabric 25 times, and after every fifth wash determining the inorganic deposits on the fabric by incinerating the standard fabric. The results are given in Table 3.

Washing conditions: German water hardness 18°, Ca:Mg=5:1 (molar), main wash only at 60° C., Miele Novotronic W917 machine, dose: 75 g per washing cycle.

TABLE 3

| Fabric incrustation [% ash] | | | | |
|---|---|---|---|---|
| | % ash after 25 washes | | | |
| | Example 4 | Example 6 | Example 5 | Example 7 |
| Terry (Vossen) | 2.71 | 1.12 | 2.38 | 2.08 |
| Cotton (Empa) | 1.84 | 0.97 | 2.05 | 1.41 |
| Cotton (WFK) | 3.93 | 3.51 | 4.8 | 3.91 |
| PE/Co (WFK) | 2.04 | 0.96 | 2.03 | 1.31 |
| Double rib (WFK) | 1.79 | 0.78 | 1.51 | 1.41 |
| Average value | 2.46 | 1.47 | 2.55 | 2.02 |

It is clear, both from the individual and also from the average incrustation values, that significantly lower incrustations were found for the pulverulent laundry and cleaning detergents ingredient according to the invention in Examples 6 and 7, compared with the prior art (Examples 4 and 5).

The following Examples 9 and 10 refer to the preparation and testing of a dishwashing composition.

For this purpose, two automatic dishwashing detergents in granular form were prepared in a Lödige plowshare mixer by mixing the ingredients in the order given in Table 4.

TABLE 4

| Compositions of Examples 9 and 10 | | |
|---|---|---|
| | Content (% by weight) | |
| Ingredients | Example 9 | Example 10 (comparison) |
| Cleaning additive | 31 | — |
| SKS-6 | — | 20 |
| Sodium carbonate | 19.5 | 23.5 |
| Nonionic[1)] | 1.5 | 1.5 |
| Trisodium citrate dihydrate | 30 | 30 |
| Sodium polycarboxylate[2)] | — | 7 |
| TAED[3)] | 5 | 5 |
| Enzymes | 3 | 3 |
| Sodium percarbonate | 10 | 10 |

TABLE 4-continued

| Compositions of Examples 9 and 10 | | |
|---|---|---|
| | Content (% by weight) | |
| Ingredients | Example 9 | Example 10 (comparison) |

[1]Genapol 2909 D, commercial product from Hoechst, Frankfurt am Main
[2]Sokalan PA 25 Cl, commercial product from BASF, Ludwigshafen
[3]TAED 3873, commercial product from Hoechst, Frankfurt am Main The cleaning composition additive used in Example 9 is the one according to Table 1, Example 3. Its composition corresponds approximately to the total of SKS-6 and sodium polycarboxylate in Example 10.

The laundry and cleaning detergents ingredient according to the invention in the present dishwashing detergent formulation of Example 9 is notable for a particularly high detergency (testing according to DIN 44990). It is particularly suitable for removing burned-on and proteinaceous food residues and tea stains. It also displays excellent dispersing behavior, in particular toward fiber-containing food residues.

Furthermore, the laundry and cleaning detergents ingredient according to the invention in the present dishwashing detergent formulation prevents damage to glass and decoration.

What is claimed is:

1. A pulverulent laundry and cleaning detergent ingredient which consists of a reaction product obtained by depositing a solution of an acidic polycarboxylate onto an alkaline silicate and drying.

2. A pulverulent laundry arid cleaning detergent ingredient as claimed in claim 1, wherein the reaction product has a weight ratio of alkaline silicate to acidic polycarboxylate of (40 to 1):1.

3. A pulverulent laundry and cleaning detergent ingredient as claimed in claim 1, wherein the reaction product has a weight ratio of alkaline silicate to acidic polycarboxylate of (20 to 2):1.

4. A pulverulent laundry and cleaning detergent ingredient as claimed in claim 1, wherein the polycarboxylate used is an unneutralized or only partially neutralized homo- and/or copolymer of acrylic acid, methacrylic acid, maleic acid, poly-aspartic acid, saccharic acid and/or other monomers.

5. A pulverulent laundry and cleaning detergent ingredient as claimed in claim 1, which consists of from 50 to 98% by weight of an alkaline silicate and from 2 to 50% by weight of a copolymer of from 10 to 70% by weight of maleic acid, from 20 to 85% by weight of acrylic acid and/or methacrylic acid, from 1 to 50% by weight of vinyl acetate and from 0 to 10% by weight of other monomers having a degree of neutralization of from 0 to 70%.

6. A pulverulent laundry and cleaning detergent ingredient as claimed in claim 1, wherein the alkaline silicate has the formula $xM_2O\ ySiO_2\ zH_2O$ having a molar ratio of $SiO_2$ to $M_2O$ of (1 to 3.5):1 where z=0 to 4 and M=Na and/or K, which may contain up to 1% by weight of other elements and/or compounds.

7. A pulverulent laundry and cleaning detergent ingredient as claimed in claim 1, wherein the alkaline silicate is amorphous sodium silicate.

8. A pulverulent laundry and cleaning detergent ingredient as claimed in claim 1, wherein the alkaline silicate is a crystalline sodium silicate.

9. A pulverulent laundry and cleaning detergent ingredient as claimed in claim 8, wherein the alkaline silicate is a crystalline sodium phyllosilicate.

10. A pulverulent laundry and cleaning detergent ingredient as claimed in claim 6, wherein the other elements and/or compounds are selected from the group consisting of aluminum, titanium, iron, calcium, magnesium, their compounds, and mixtures thereof.

11. A process for preparing the pulverulent laundry and cleaning detergent ingredient according to claim 1 which comprises depositing a solution of an acidic polycarboxylate solution onto an alkaline silicate and drying.

12. A process as claimed in claim 11, wherein from 2 to 60 parts by weight of acidic polycarboxylate solution are deposited onto 100 parts by weight of alkaline silicate.

13. A process as claimed in claim 11, wherein from 10 to 40 parts by weight of acidic polycarboxylate solution are deposited onto 100 parts by weight of alkaline silicate.

14. The process as claimed in claim 11, wherein the solution of the polycarboxylate is a neutralized or only partially neutralized homo- or a copolyrmer of an acid selected from the group consisting of acrylic acid, methacrylic acid, maleic acid, polyaspartic acid, and saccharic acid and/or other monomers.

15. A process as claimed in claim 11, wherein the polycarboxylate solution is deposited onto the alkaline silicate in a solids mixer which contains a liquid-spraying device.

16. A process as claimed in claim 11, wherein the reaction product of alkaline silicate and acidic polycarboxylate solution is dried at temperatures of from 40 to 150° C. for a period of from 5 to 120 minutes.

17. A process for using the reaction product of an alkaline silicate and an acidic polycarboxylate according to claim 1, wherein said reaction product is obtained by contacting the alkaline silicate with a solution of the acidic polycarboxylate and drying to provide a dry reaction product, said process further comprising combining said dry reaction product with at least one component selected from the group consisting of surfactant, bleach, washing alkali, dispersant, enzyme, builder, polyelectrolyte and sodium triphosphate.

18. The process of claim 17, wherein said combining is a dry mixing process.

19. A laundry detergent made by the process of claim 17.

20. A cleaning detergent made by the process of claim 17.

21. A dishwashing detergent made by the process of claim 17.

* * * * *